US009791879B2

(12) United States Patent
Horng et al.

(10) Patent No.: US 9,791,879 B2
(45) Date of Patent: Oct. 17, 2017

(54) MOS-BASED VOLTAGE REFERENCE CIRCUIT

(71) Applicant: Taiwan Semiconductor Manufacturing Company Limited, Hsin-Chu (TW)

(72) Inventors: Jaw-Juinn Horng, Hsinchu (TW); Amit Kundu, Hsinchu (TW); Chung-Hui Chen, HsinChu (TW); Yung-Chow Peng, Hsinchu (TW)

(73) Assignee: Taiwan Semiconductor Manufacturing Company Limited (TW)

( * ) Notice: Subject to any disclaimer, the term of this patent is extended or adjusted under 35 U.S.C. 154(b) by 965 days.

(21) Appl. No.: 14/063,246

(22) Filed: Oct. 25, 2013

(65) Prior Publication Data

US 2015/0115717 A1 Apr. 30, 2015

(51) Int. Cl.
*G05F 3/16* (2006.01)
*G05F 3/30* (2006.01)

(52) U.S. Cl.
CPC ..... *G05F 3/16* (2013.01); *G05F 3/30* (2013.01); *Y10T 307/549* (2015.04)

(58) Field of Classification Search
CPC ..... G05F 3/16; G05F 3/30; Y10T 307/549
See application file for complete search history.

(56) References Cited

U.S. PATENT DOCUMENTS

2006/0082410 A1* 4/2006 Khan ..... G05F 3/30 327/539
2009/0051341 A1* 2/2009 Chang ..... G05F 3/30 323/313
2009/0261895 A1* 10/2009 Lee ..... G05F 3/30 327/539
2010/0013540 A1* 1/2010 Takaramoto ..... G05F 3/30 327/335
2011/0187344 A1* 8/2011 Iacob ..... G05F 3/16 323/315
2013/0200878 A1* 8/2013 Kalb ..... G05F 3/20 323/313
2014/0015504 A1* 1/2014 Sano ..... H02M 3/158 323/282

* cited by examiner

*Primary Examiner* — Adi Amrany
*Assistant Examiner* — Joel Barnett
(74) *Attorney, Agent, or Firm* — Cooper Legal Group, LLC

(57) ABSTRACT

A voltage reference circuit is provided that includes a first circuit, a second circuit and a third circuit. The first circuit has a first MOS transistor pair and the second circuit has a second MOS transistor pair. The first circuit is configured to provide a first voltage component that changes at a first rate having a first slope as a temperature to which the voltage reference circuit is subjected changes. The second circuit is configured to provide a second voltage component that changes at a second rate having a second slope as the temperature changes. The third circuit is configured to use the first voltage component and the second voltage component to generate the reference voltage component that changes at a fifth rate having a fifth slope as the temperature changes. The fifth slope is substantially equal to zero to promote insensitivity of the reference voltage component to temperature changes.

20 Claims, 4 Drawing Sheets

MOS-BASED VOLTAGE REFERENCE CIRCUIT

BACKGROUND

A voltage reference circuit is an electronic device that is configured to produce a constant voltage.

DETAILED DESCRIPTION

Figure 1:
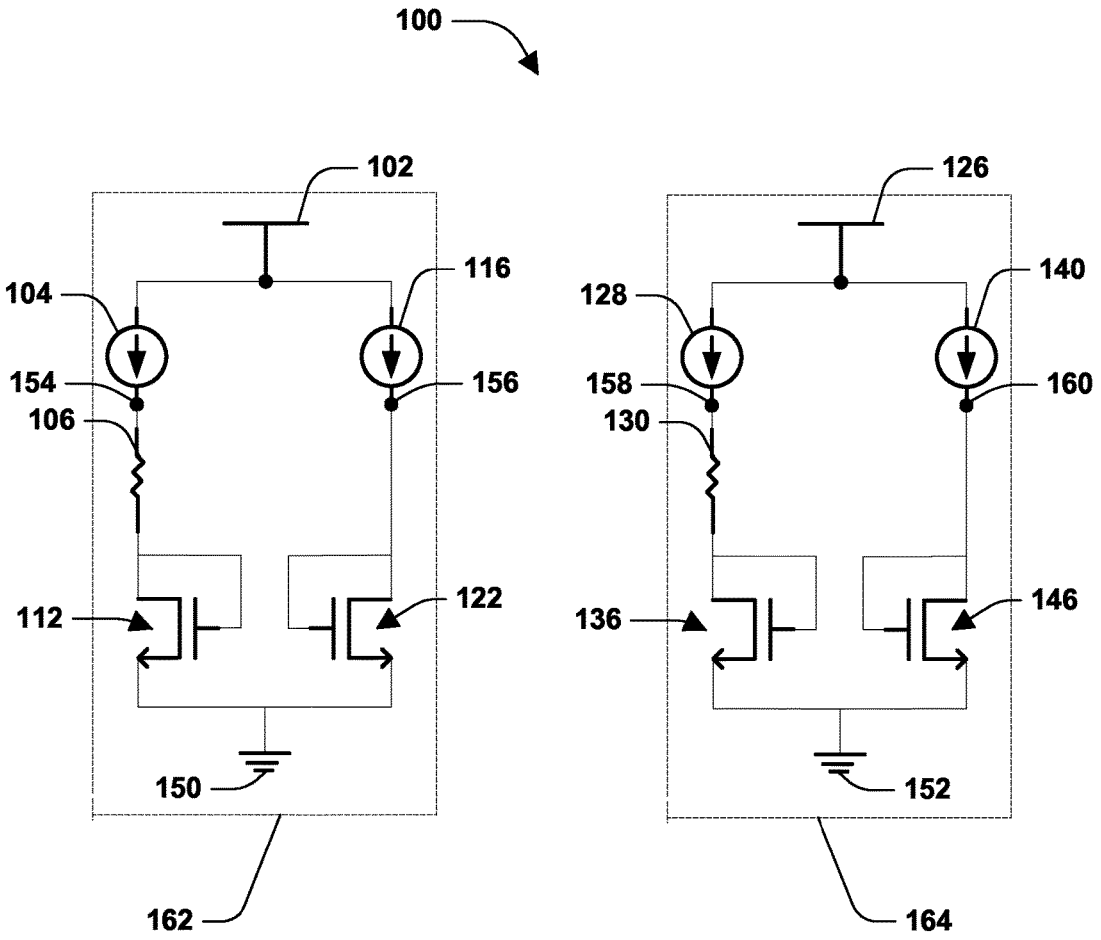
FIG. 1 is an illustration of a circuit, according to some embodiments.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter may be practiced without these specific details. In other instances, structures and devices are illustrated in block diagram form in order to facilitate describing the claimed subject matter.

In some embodiments, a voltage reference circuit is provided. In some embodiments, the voltage reference circuit comprises a first circuit and a second circuit. The first circuit comprises a first transistor pair which comprises a first MOS transistor and a second MOS transistor and the second circuit comprises a second transistor pair which comprises a third MOS transistor and a fourth MOS transistor. The first MOS transistor and the second MOS transistor respectively comprise the same type of MOS transistor. In this way, if the first MOS transistor comprises a first NMOS transistor then the second MOS transistor comprises a second NMOS transistor. The third MOS transistor and the fourth MOS transistor respectively comprise the same type of MOS transistor. In this way, if the third MOS transistor comprises a third NMOS transistor then the fourth MOS transistor comprises a fourth NMOS transistor. In some embodiments, the second transistor pair comprises a same type of MOS transistors as those that are part of the first transistor pair. In this way, if the first MOS transistor comprises a first NMOS transistor, and the second MOS transistor comprises a second NMOS transistor, then the third MOS transistor comprises a third NMOS transistor and the fourth MOS transistor comprises a fourth NMOS transistor. In some embodiments, the second transistor pair comprises a different type of MOS transistors than those that are part of the first transistor pair. In this way, if the first MOS transistor comprises a first NMOS transistor, and the second MOS transistor comprises a second NMOS transistor, then the third MOS transistor comprises a third PMOS transistor and the fourth MOS transistor comprises a fourth PMOS transistor.

FIG. 1 illustrates at least some of a voltage reference circuit 100, in accordance with various embodiments, where a first transistor pair comprises a same type of MOS transistors as those that are part of a second transistor pair. A first circuit 162 comprises a first current source 104, a second current source 116, a first node 154, a second node 156, a first resistor 106 and a first transistor pair. The first circuit 162 is connected to a first voltage source 102 and a second voltage source 150. In some embodiments, the second voltage source 150 is ground. The first transistor pair comprises a first transistor and a second transistor. The first transistor comprises a first NMOS transistor 112. The second transistor comprises a second NMOS transistor 122. The first voltage source 102 is connected to the first current source 104 and to the second current source 116. The first current source 104 is connected to the first node 154. The first node 154 is connected to the first resistor 106. The first resistor 106 is connected to a drain of the first NMOS transistor 112. The drain of the first NMOS transistor 112 is connected to a gate of the first NMOS transistor 112. A source of the first NMOS transistor 112 is connected to the second voltage source 150. The second voltage source 150 is connected to a source of the second NMOS transistor 122. A drain of the second NMOS transistor 122 is connected to a gate of the second NMOS transistor 122. The drain of the second NMOS transistor 122 is connected to the second node 156. The second node 156 is connected to the second current source 116.

A second circuit 164 comprises a third current source 128, a fourth current source 140, a third node 158, a fourth node 160, a second resistor 130 and a second transistor pair. The second circuit 164 is connected to a third voltage source 126 and a fourth voltage source 152. In some embodiments, the fourth voltage source 152 is ground. The second transistor pair comprises a third transistor and a fourth transistor. The third transistor comprises a third NMOS transistor 136. The fourth transistor comprises a fourth NMOS transistor 146. The third voltage source 126 is connected to the third current source 128 and to the fourth current source 140. The third current source 128 is connected to the third node 158. The third node 158 is connected to the second resistor 130. The second resistor 130 is connected to a drain of the third NMOS transistor 136. The drain of the third NMOS transistor 136 is connected to a gate of the third NMOS transistor 136. A source of the third NMOS transistor 136 is connected to the fourth voltage source 152. The fourth voltage source 152 is connected to a source of the fourth NMOS transistor 146. A drain of the fourth NMOS transistor 146 is connected to a gate of the fourth NMOS transistor 146. The drain of the fourth NMOS transistor 146 is connected to the fourth node 160. The fourth node 160 is connected to the fourth current source 140.

In some embodiments, the first voltage source 102 is equal to the third voltage source 126. In some embodiments, the first voltage source 102 has a voltage of less than 0.7 volts. In some embodiments, the third voltage source 126 has a voltage of less than 0.7 volts. In some embodiments, the second voltage source 150 is equal to the fourth voltage source 152. In some embodiments, the second voltage source 150 is ground. In some embodiments, the fourth voltage source 152 is ground.

The first current source 104 comprises electronic components. The first current source 104 is configured to provide a first current that generates a first node voltage component at the first node 154. The second current source 116 comprises electronic components. The second current source 116 is configured to provide a second current that generates a second node voltage component at the second node 156 that is substantially equal to the first node voltage component.

The third current source 128 comprises electronic components. The third current source 128 is configured to provide a third current that generates a third node voltage component at the third node 158. The fourth current source 140 comprises electronic components. The fourth current source 140 is configured to provide a fourth current that generates a fourth node voltage component at the fourth node 160 that is substantially equal to the third node voltage component.

In some embodiments, the first circuit 162 is configured so that the first NMOS transistor 112 and the second NMOS transistor 122 are respectively configured to operate in a sub-threshold region. In some embodiments, the first resistor 106 is adjusted so that a voltage across the first NMOS transistor 112 is less than a threshold voltage of the first NMOS transistor 112. In some embodiments, the first resistor 106 is adjusted so that a voltage across the second NMOS transistor 122 is less than a threshold voltage of the second NMOS transistor 122. In some embodiments, if the threshold voltage of the first NMOS transistor 112 is 0.4 volts and the threshold voltage of the second NMOS transistor 122 is 0.4 volts, then the first resistor 106 is thus adjusted so that the voltage across the first NMOS transistor 112 is less than 0.4 volts and also so that the voltage across the second NMOS transistor 122 is less than 0.4 volts. In some embodiments, the second circuit 164 is configured so that the third NMOS transistor 136 and the fourth NMOS transistor 146 are respectively configured to operate in a saturation region. In some embodiments, the second resistor 130 is adjusted so that a voltage across the third NMOS transistor 136 is greater than a threshold voltage of the third NMOS transistor 136. In some embodiments, the second resistor 130 is adjusted so that a voltage across the fourth NMOS transistor 146 is greater than a threshold voltage of the fourth NMOS transistor 146. In some embodiments, if the threshold voltage of the third NMOS transistor 136 is 0.4 volts and the threshold voltage of the fourth NMOS transistor 146 is 0.4 volts, then the second resistor 130 is thus adjusted so that the voltage across the third NMOS transistor 136 is greater than 0.4 volts and also so that the voltage across the fourth NMOS transistor 146 is greater than 0.4 volts. In this way, the fourth node voltage component is greater than the second node voltage component.

A current flowing through the first NMOS transistor 112 and a current flowing through the second NMOS transistor 122 respectively change as a temperature to which the voltage reference circuit 100 is subjected changes, such as increases or decreases. In this way, the first node voltage component and the second node voltage component respectively change at a first rate having a first slope as the temperature changes.

A current flowing through the third NMOS transistor 136 and a current flowing through the fourth NMOS transistor 146 respectively change as the temperature changes, such as increases or decreases. In this way, the third node voltage component and the fourth node voltage component respectively change at a second rate having a second slope as the temperature changes. In some embodiments, the first slope is greater than the second slope because the fourth node voltage component is greater than the second node voltage component.

Figure 2:
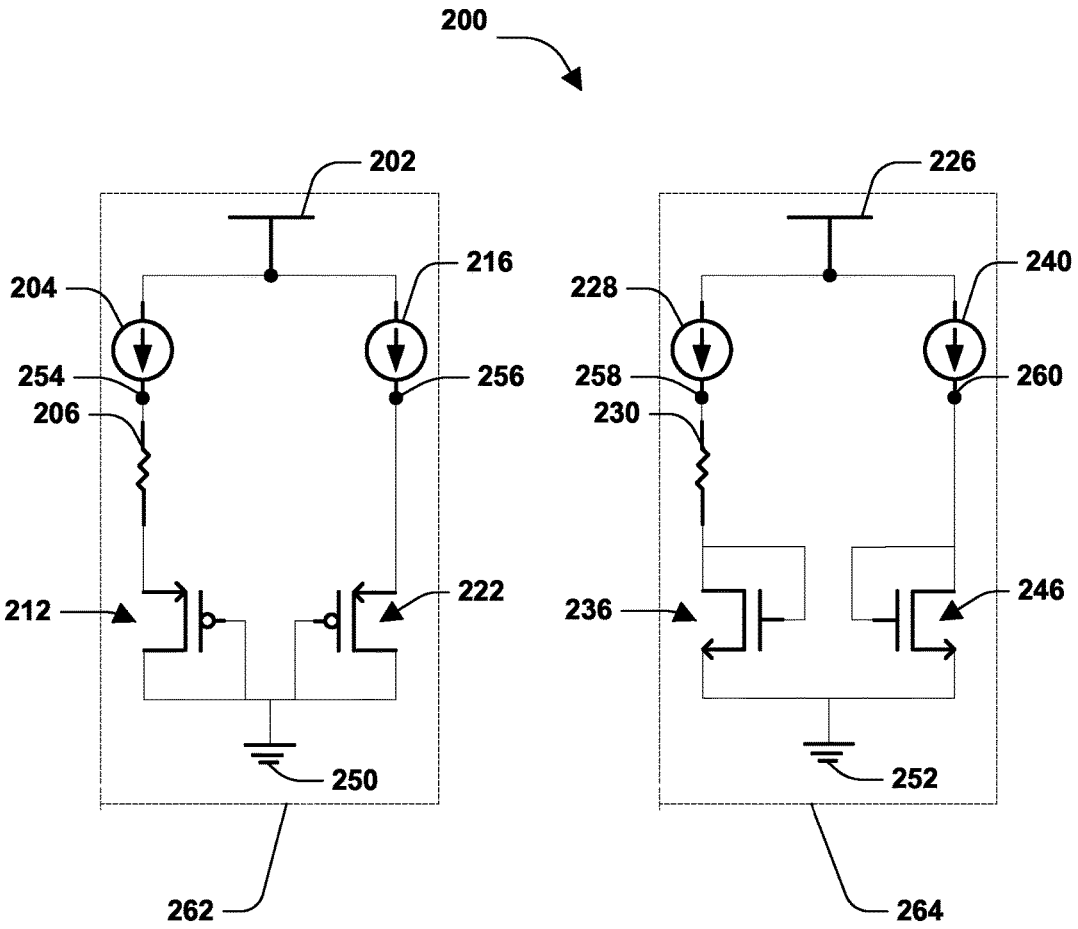
FIG. 2 is an illustration of a circuit, according to some embodiments.

FIG. 2 illustrates at least some of a voltage reference circuit 200 in accordance with an embodiment where a first transistor pair comprises a different type of MOS transistors than those that are a part of a second transistor pair. A first circuit 262 comprises a first current source 204, a second current source 216, a first node 254, a second node 256, a first resistor 206 and a first transistor pair. The first circuit is connected to a first voltage source 202 and a second voltage source 250. The first transistor pair comprises a first transistor and a second transistor. The first transistor comprises a first PMOS transistor 212. The second transistor comprises a second PMOS transistor 222. The first voltage source 202 is connected to the first current source 204 and to the second current source 216. The first current source 204 is connected to the first node 254. The first node 254 is connected to the first resistor 206. The first resistor 206 is connected to a source of the first PMOS transistor 212. A gate of the first PMOS transistor 212 is connected to a drain of the first PMOS transistor 212. The drain of the first PMOS transistor 212 is connected to the second voltage source 250. The second voltage source 250 is connected to a drain of the second PMOS transistor 222. The drain of the second PMOS transistor 222 is connected to a gate of the second PMOS transistor 222. A source of the second PMOS transistor 222 is connected to the second node 256. The second node 256 is connected to the second current source 216.

A second circuit 264 comprises a third current source 228, a fourth current source 240, a third node 258, a fourth node 260, a second resistor 230 and a second transistor pair. The second circuit 264 is connected to a third voltage source 226 and a fourth voltage source 252. The second transistor pair comprises a third transistor and a fourth transistor. The third transistor comprises a third NMOS transistor 236. The fourth transistor comprises a fourth NMOS transistor 246. The third voltage source 226 is connected to the third current source 228 and to the fourth current source 240. The third current source 228 is connected to the third node 258. The third node 258 is connected to the second resistor 230. The second resistor 230 is connected to a drain of the third NMOS transistor 236. The drain of the third NMOS transistor 236 is connected to a gate of the third NMOS transistor 236. A source of the third NMOS transistor 236 is connected to the fourth voltage source 252. The fourth voltage source 252 is connected to a source of the fourth NMOS transistor 246. A drain of the fourth NMOS transistor 246 is connected to a gate of the fourth NMOS transistor 246. The drain of the fourth NMOS transistor 246 is connected to the fourth node 260. The fourth node 260 is connected to the fourth current source 240.

In some embodiments, the first voltage source 202 is equal to the third voltage source 226. In some embodiments, the first voltage source 202 has a voltage of less than 0.7 volts. In some embodiments, the third voltage source 226 has a voltage of less than 0.7 volts. In some embodiments, the second voltage source 250 is equal to the fourth voltage source 252. In some embodiments, the second voltage source 250 is ground. In some embodiments, the fourth voltage source 252 is ground.

The first current source 204 comprises electronic components. The first current source 204 is configured to provide a first current that generates a first node voltage component at the first node 254. The second current source 216 comprises electronic components. The second current source 216 is configured to provide a second current that generates a second node voltage component at the second node 256 that is substantially equal to the first node voltage component.

The third current source 228 comprises electronic components. The third current source 228 is configured to provide a third current that generates a third node voltage component at the third node 258. The fourth current source 240 comprises electronic components. The fourth current source 240 is configured to provide a fourth current that generates a fourth node voltage component at the fourth node 260 that is substantially equal to the third node voltage component.

In some embodiments, the first circuit 262 is configured so that the first PMOS transistor 212 and the second PMOS transistor 222 are respectively configured to operate in a saturation region. In some embodiments, the first resistor 206 is adjusted so that a voltage across the first PMOS transistor 212 is greater than a threshold voltage of the first PMOS transistor 212. In some embodiments, the first resistor 206 is adjusted so that a voltage across the second PMOS transistor 222 is greater than a threshold voltage of the second PMOS transistor 222. If the threshold voltage of the first PMOS transistor 212 is 0.5 volts and the threshold voltage of the second PMOS transistor 222 is 0.5 volts, then the first resistor 206 is thus adjusted so that the voltage across the first PMOS transistor 212 is greater than 0.5 volts and also so that the voltage across the second PMOS transistor 222 is greater than 0.5 volts.

In some embodiments, the second circuit 264 is configured so that the third NMOS transistor 236 and the fourth NMOS transistor 246 are respectively configured to operate in a saturation region. In some embodiments, the second resistor 230 is adjusted so that a voltage across the third NMOS transistor 236 is greater than a threshold voltage of the third NMOS transistor 236. In some embodiments, the second resistor 230 is adjusted so that a voltage across the fourth NMOS transistor 246 is greater than a threshold voltage of the fourth NMOS transistor 246. If the threshold voltage of the third NMOS transistor 236 is 0.5 volts and the threshold voltage of the fourth NMOS transistor 246 is 0.5 volts, then the second resistor 230 is thus adjusted so that the voltage across the third NMOS transistor 236 is greater than 0.5 volts and also so that the voltage across the fourth NMOS transistor 246 is greater than 0.5 volts.

A current flowing through the first PMOS transistor 212 and a current flowing through the second PMOS transistor 222 respectively change as a temperature to which the voltage reference circuit 200 is subjected changes, such as increases or decreases. In this way, the first node voltage component and the second node voltage component respectively change at a first rate having a first slope as the temperature changes. Because the first PMOS transistor 212 and the second PMOS transistor 222 are respectively configured to operate in the saturation region, the current flowing through the first PMOS transistor 212 and the current flowing through the second PMOS transistor 222 are respectively inversely proportional to a square root of a mobility of the respective transistors.

A current flowing through the third NMOS transistor 236 and a current flowing through the fourth NMOS transistor 246 respectively change as the temperature changes, such as increases or decreases. In this way, the third node voltage component and the fourth node voltage component respectively change at a second rate having a second slope as the temperature changes. Because the third NMOS transistor 236 and the fourth NMOS transistor 246 are respectively configured to operate in the saturation region, the current flowing through the third NMOS transistor 236 and the current flowing through the fourth NMOS transistor 246 are respectively inversely proportional to a square root of a mobility of the respective transistors.

The first PMOS transistor 212 and the second PMOS transistor 222 respectively have a PMOS temperature coefficient for mobility. The third NMOS transistor 236 and the fourth NMOS transistor 246 respectively have an NMOS temperature coefficient for mobility. The PMOS temperature coefficient for mobility is different from the NMOS temperature coefficient for mobility. In this manner, the first slope is different from the fourth slope.

The embodiment illustrated in FIG. 1 is designed such that the current flowing through the first NMOS transistor 112 and the current flowing through the third NMOS transistor 136, respectively, are not functions of the threshold voltage of the first NMOS transistor 112 and the threshold voltage of the third NMOS transistor 136, respectively. The embodiment illustrated in FIG. 1 is designed such that the current flowing through the first NMOS transistor 112 and the current flowing through the third NMOS transistor 136, respectively, are functions of a mobility of the first NMOS transistor 112 and a mobility of the third NMOS transistor 136, respectively. The threshold voltage of the first NMOS transistor 112 varies more than the mobility of the first NMOS transistor 112. In some embodiments, a voltage reference circuit that depends on a mobility of a MOS transistor thus yields a more accurate output than a voltage reference circuit that depends on a voltage threshold of a MOS transistor.

The embodiment illustrated in FIG. 2 is designed such that the current flowing through the first PMOS transistor 212 and the current flowing through the third NMOS transistor 236, respectively, are functions of a mobility of the first PMOS transistor 212 and a mobility of the third NMOS transistor 236, respectively. Because of the difference in the type of transistor between the first PMOS transistor 212 and the third NMOS transistor 236, there are process corners, such as a slow-fast corner or a fast-slow corner, where the first PMOS transistor 212 and the third NMOS transistor 236, respectively, behave differently from one other. Because of these process corners, the accuracy of an output of the embodiment illustrated in FIG. 2 is less than the accuracy of an output of the embodiment illustrated in FIG. 1, in some embodiments.

Figure 3:
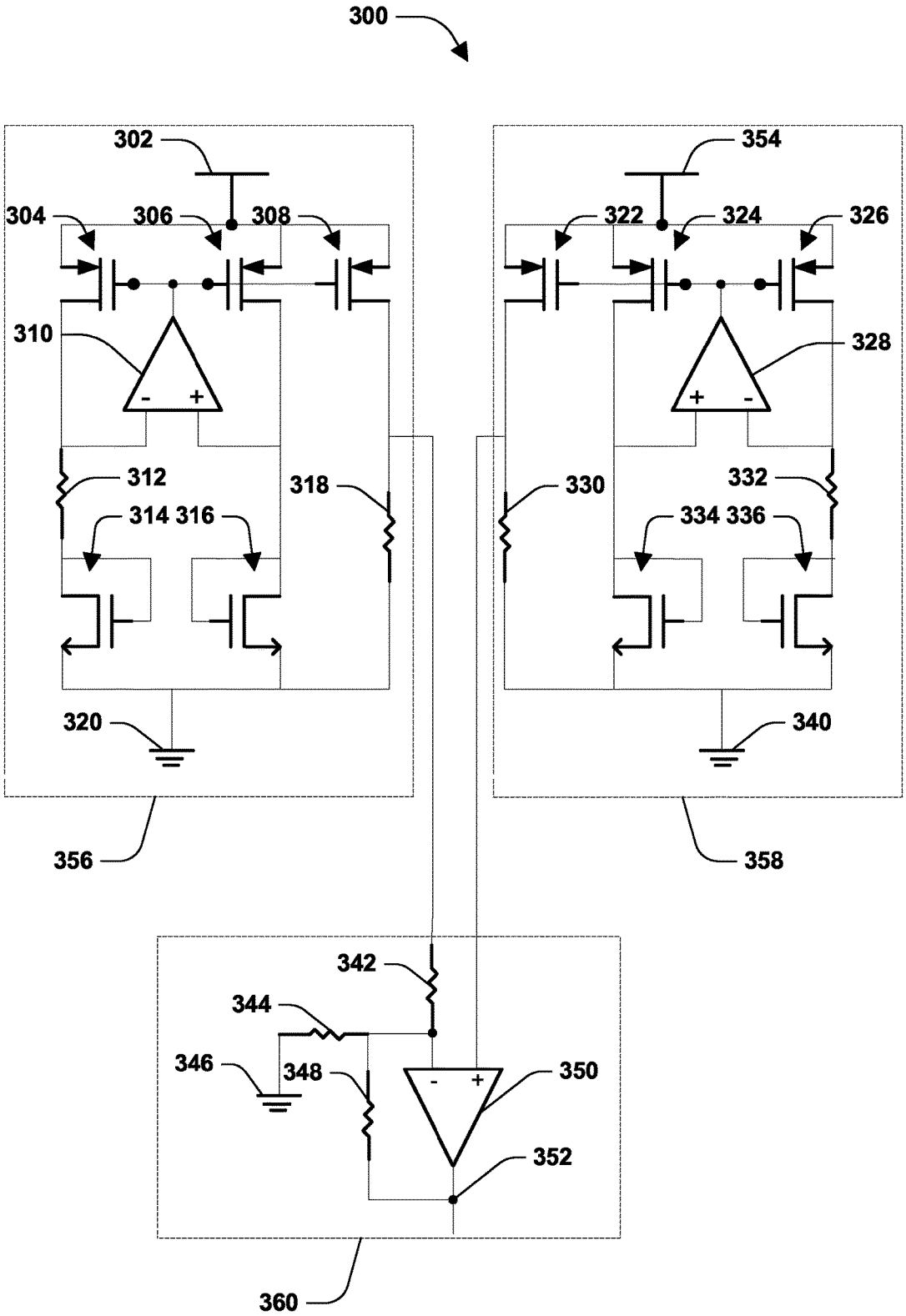
FIG. 3 is an illustration of a circuit, according to some embodiments.

FIG. 3 illustrates at least some of a voltage reference circuit 300 in accordance with an embodiment where a first transistor pair comprises a same type of MOS transistors as those that are part of a second transistor pair. A first circuit 356 comprises a first resistor 312, a second resistor 318, a first transistor pair, a fifth transistor, a sixth transistor, a seventh transistor and a first operational amplifier 310. The first circuit 356 is connected to a first voltage source 302 and a second voltage source 320. The first transistor pair comprises a first transistor and a second transistor. The first transistor comprises a first NMOS transistor 314. The second transistor comprises a second NMOS transistor 316. The fifth transistor comprises a fifth PMOS transistor 304. The sixth transistor comprises a sixth PMOS transistor 306. The seventh transistor comprises a seventh PMOS transistor 308. The first voltage source 302 is connected to a source of the fifth PMOS transistor 304. The first voltage source 302 is connected to a source of the sixth PMOS transistor 306. The first voltage source 302 is also connected to a source of the seventh PMOS transistor 308. A gate of the fifth PMOS transistor 304 is connected to a gate of the sixth PMOS transistor 306 which is connected to a gate of the seventh PMOS transistor 308. The gate of the seventh PMOS transistor 308 is connected to an output of the first operational amplifier 310. An inverting input of the first operational amplifier 310 is connected to a drain of the fifth PMOS transistor 304. A non-inverting input of the first operational amplifier 310 is connected to a drain of the sixth PMOS transistor 306. The drain of the fifth PMOS transistor 304 is connected to the first resistor 312. The first resistor 312 is connected to a drain of the first NMOS transistor 314 which is connected to a gate of the first NMOS transistor 314. A source of the first NMOS transistor 314 is connected to the second voltage source 320. The non-inverting input of the first operational amplifier 310 is connected to a drain of the second NMOS transistor 316 which is connected to a gate of the second NMOS transistor 316. A source of the second NMOS transistor 316 is connected to the second voltage source 320. A drain of the seventh PMOS transistor 308 is connected to the second resistor 318. The second resistor 318 is connected to the second voltage source 320.

A second circuit 358 comprises a third resistor 332, a fourth resistor 330, a second transistor pair, an eighth transistor, a ninth transistor, a tenth transistor and a second operational amplifier 328. The second circuit 358 is connected to a third voltage source 354 and a fourth voltage source 340. The second transistor pair comprises a third transistor and a fourth transistor. The third transistor comprises a third NMOS transistor 336. The fourth transistor comprises a fourth NMOS transistor 334. The eighth transistor comprises an eighth PMOS transistor 326. The ninth transistor comprises a ninth PMOS transistor 324. The tenth transistor comprises a tenth PMOS transistor 322. The third voltage source 354 is connected to a source of the eighth PMOS transistor 326. The third voltage source 354 is connected to a source of the ninth PMOS transistor 324. The third voltage source 354 is also connected to a source of the tenth PMOS transistor 322. A gate of the eighth PMOS transistor 326 is connected to a gate of the ninth PMOS transistor 324 which is connected to a gate of the tenth PMOS transistor 322. The gate of the tenth PMOS transistor 322 is connected to an output of the second operational amplifier 328. An inverting input of the second operational amplifier 328 is connected to a drain of the eighth PMOS transistor 326. A non-inverting input of the second operational amplifier 328 is connected to a drain of the ninth PMOS transistor 324. The drain of the eighth PMOS transistor 326 is connected to the third resistor 332. The third resistor 332 is connected to a drain of the third NMOS transistor 336 which is connected to a gate of the third NMOS transistor 336. A source of the third NMOS transistor 336 is connected to the fourth voltage source 340. The non-inverting input of the second operational amplifier 328 is connected to a drain of the fourth NMOS transistor 334 which is connected to a gate of the fourth NMOS transistor 334. A source of the fourth NMOS transistor 334 is connected to the fourth voltage source 340. A drain of the tenth PMOS transistor 322 is connected to the fourth resistor 330. The fourth resistor 330 is connected to the fourth voltage source 340.

A third circuit 360 of the voltage reference circuit 300 comprises a fifth resistor 342, a sixth resistor 344, a seventh resistor 348, a third operational amplifier 350 and a reference voltage node 352. The third circuit 360 is connected to a fifth voltage source 346.

In some embodiments, the first voltage source 302 comprises a voltage level that is equal to the third voltage source 354. In some embodiments, the second voltage source 320, the fourth voltage source 340 and the fifth voltage source 346 are respectively at ground.

The first operational amplifier 310 and at least one of the fifth PMOS transistor 304, the sixth PMOS transistor 306 or the seventh PMOS transistor 308 are configured to provide a voltage at the inverting input of the first operational amplifier 310 and to provide a voltage at the non-inverting input of the first operational amplifier 310 that is substantially equal to the voltage at the inverting input of the first operational amplifier 310.

The second operational amplifier 328 and at least one of the eighth PMOS transistor 326, the ninth PMOS transistor 324 or the tenth PMOS transistor 322 are configured to provide a voltage at the inverting input of the second operational amplifier 328 and to provide a voltage at the non-inverting input of the second operational amplifier 328 that is substantially equal to the voltage at the inverting input of the second operational amplifier 328.

In some embodiments, the first circuit 356 is configured so that the first NMOS transistor 314 and the second NMOS transistor 316 are respectively configured to operate in a sub-threshold region. In some embodiments, the first resistor 312 is adjusted so that a voltage across the first NMOS transistor 314 is less than a threshold voltage of the first NMOS transistor 314. In some embodiments, the first resistor 312 is adjusted so that a voltage across the second NMOS transistor 316 is less than a threshold voltage of the second NMOS transistor 316. If the threshold voltage of the first NMOS transistor 314 is 0.5 volts and the threshold voltage of the second NMOS transistor 314 is 0.5 volts, then the first resistor 312 is thus adjusted so that the voltage across the first NMOS transistor 314 is less than 0.5 volts and also so that the voltage across the second NMOS transistor 316 is less than 0.5 volts.

In some embodiments, the second circuit 358 is configured so that the third NMOS transistor 336 and the fourth NMOS transistor 334 are respectively configured to operate in a saturation region. In some embodiments, the third resistor 332 is adjusted so that a voltage across the third NMOS transistor 336 is greater than a threshold voltage of the third NMOS transistor 336. In some embodiments, the third resistor 332 is adjusted so that a voltage across the fourth NMOS transistor 334 is greater than a threshold voltage of the fourth NMOS transistor 334. If the threshold voltage of the third NMOS transistor 336 is 0.5 volts and the threshold voltage of the fourth NMOS transistor 334 is 0.5 volts, then the third resistor 332 is thus adjusted so that the voltage across the third NMOS transistor 336 is greater than 0.5 volts and also so that the voltage across the fourth NMOS transistor 334 is greater than 0.5 volts.

A current flowing through the first NMOS transistor 314 and a current flowing through the second NMOS transistor 316 respectively change as a temperature to which the voltage reference circuit 300 is subjected changes, such as increases or decreases. In this way, the first voltage component changes at a first rate having a first slope as the temperature changes. In some embodiments, the first slope is positive as the temperature increases.

A current flowing through the third NMOS transistor 336 and a current flowing through the fourth NMOS transistor 334 respectively change as the temperature changes, such as increases or decreases. In this way, the second voltage component changes at a second rate having a second slope as the temperature changes. In some embodiments, the second slope is positive as the temperature increases. In some embodiments, the first slope is greater than the second slope.

A node that exists between the drain of the seventh PMOS transistor 308 and the second resistor 318, and comprises the first voltage component, is connected to the fifth resistor 342, which is connected to the inverting input of the third operational amplifier 350. A node that exists between the drain of the tenth PMOS transistor 322 and the fourth resistor 330, and comprises the second voltage component, is connected to the non-inverting input of the third operational amplifier 350.

At least one of the fifth resistor 342, the sixth resistor 344, the seventh resistor 348 or the third operational amplifier 350 are configured to subtract the first voltage component from the second voltage component to generate a third voltage component that changes at a third rate having a third slope as the temperature changes. In some embodiments, the third slope is negative as the temperature increases.

At least one of the fifth resistor 342, the sixth resistor 344, the seventh resistor 348 or the third operational amplifier 350 are configured to apply a gain to the third voltage component to generate a fourth voltage component that changes at a fourth rate having a fourth slope as the temperature changes. In some embodiments, the fourth slope is negative as the temperature increases.

At least one of the fifth resistor 342, the sixth resistor 344, the seventh resistor 348 or the third operational amplifier 350 are configured to combine the second voltage component with the fourth voltage component to generate a reference voltage component that exists at the reference voltage node 352 and changes at a fifth rate having a fifth slope as the temperature changes. At least one of the fifth resistor 342, the sixth resistor 344 or the seventh resistor 348 are modified so that the absolute value of the fourth slope as the temperature increases is substantially equal to the second slope as the temperature increases. In this way, the fifth slope is substantially equal to zero.

In some embodiments, the circuit 100 illustrated in FIG. 1 is connected to a third circuit that is configured to combine the first node voltage component and the third node voltage component to generate a voltage that experiences little to no change as the temperature to which the circuit 100 is subjected changes.

In some embodiments, the circuit 200 illustrated in FIG. 2 is connected to a third circuit that is configured to combine the first node voltage component and the third node voltage component to generate a voltage that experiences little to no change as the temperature to which the circuit 200 is subjected changes.

Figure 4:
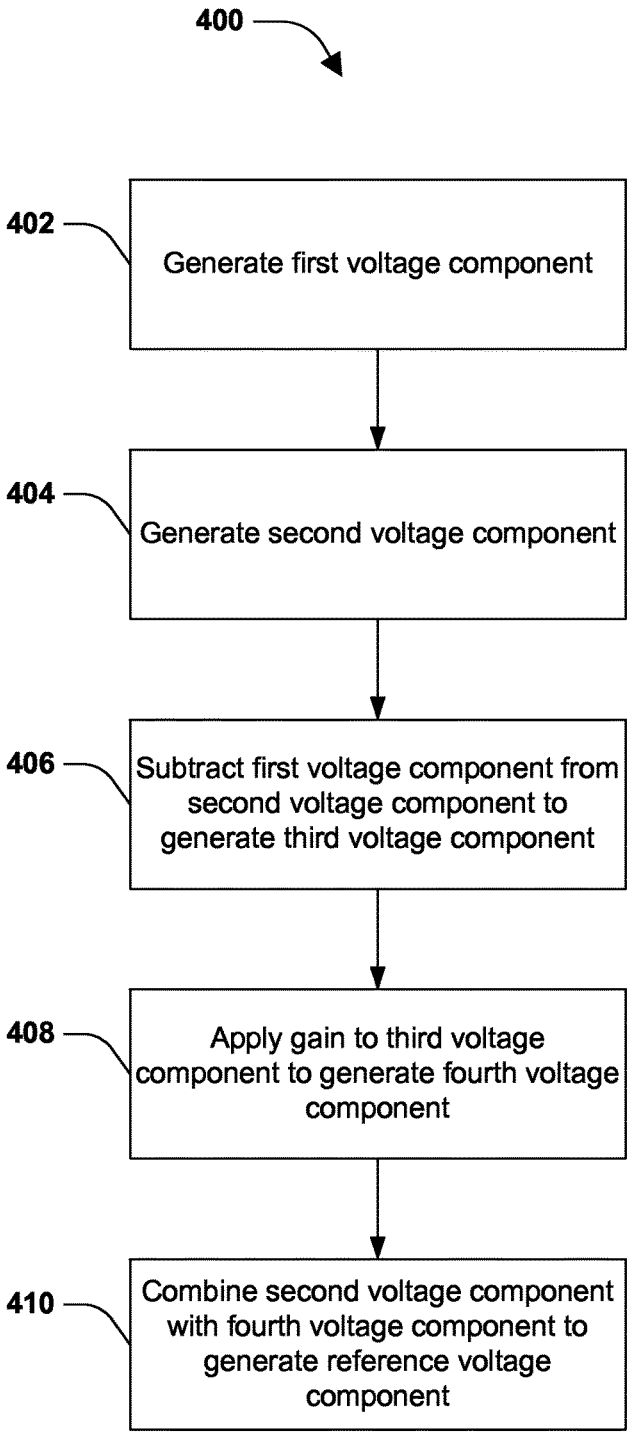
FIG. 4 is a flow diagram illustrating a method for reducing the effect of a temperature on a reference voltage component.

A method 400 for reducing the effect of a temperature on a reference voltage component in a voltage reference circuit is illustrated in FIG. 4. At 402, a first voltage component is generated using a first MOS transistor pair. The first voltage component changes at a first rate having a first slope as a temperature to which the voltage reference circuit is subjected changes, such as increases or decreases. At 404, a second voltage component is generated using a second MOS transistor pair. The second voltage component changes at a second rate having a second slope as the temperature changes. In some embodiments, the first slope and the second slope are respectively positive as the temperature increases. At 406, the first voltage component is subtracted from the second voltage component to generate a third voltage component that changes at a third rate having a third slope as the temperature changes. In some embodiments, the third slope is negative as the temperature increases. At 408, a gain is applied to the third voltage component to generate a fourth voltage component that changes at a fourth rate having a fourth slope as the temperature changes. In some embodiments, the fourth slope is negative as the temperature increases. At 410, the second voltage component is combined with the fourth voltage component so that a reference voltage component is generated that changes at a fifth rate having a fifth slope as the temperature changes.

In some embodiments, the gain used is chosen so that the fourth slope has an absolute value that is substantially equal to the second slope, as the temperature increases. In this way, the fifth slope is substantially equal to zero to promote insensitivity of the reference voltage component to changes in temperature.

According to some embodiments, a voltage reference circuit is provided. The voltage reference circuit comprises a first circuit that is configured to provide a first voltage component. The first circuit comprises a first transistor pair which comprises a first transistor and a second transistor. The first transistor comprises a first PMOS transistor or a first NMOS transistor. The second transistor comprises a second PMOS transistor when the first transistor comprises the first PMOS transistor. The second transistor comprises a second NMOS transistor when the first transistor comprises the first NMOS transistor. The voltage reference circuit also comprises a second circuit that is configured to provide a second voltage component. The second circuit comprises a second transistor pair which comprises a third transistor and a fourth transistor. The third transistor comprises a third PMOS transistor when the first transistor comprises the first PMOS transistor. The third transistor comprises a third NMOS transistor when the first transistor comprises the first NMOS transistor. The fourth transistor comprises a fourth PMOS transistor when the first transistor comprises the first PMOS transistor. The fourth transistor comprises a fourth NMOS transistor when the first transistor comprises the first NMOS transistor.

According to some embodiments, a method is provided. The method comprises generating a first voltage component using a first MOS transistor pair that changes at a first rate having a first slope as a temperature to which the voltage reference circuit is subjected changes. The method also comprises generating a second voltage component using a second MOS transistor pair that changes at a second rate having a second slope as the temperature changes. The method also comprises subtracting the first voltage component from the second voltage component to generate a third voltage component that changes at a third rate having a third slope as the temperature changes. The method also comprises applying a gain to the third voltage component to generate a fourth voltage component that changes at a fourth rate having a fourth slope as the temperature changes. The method also comprises combining the second voltage component with the fourth voltage component so that a reference voltage component is generated that changes at a fifth rate having a fifth slope as the temperature changes.

According to some embodiments, a voltage reference circuit is provided. The voltage reference circuit comprises a first circuit configured to provide a first voltage component that changes at a first rate having a first slope as a temperature to which the voltage reference circuit is subjected changes. The first circuit comprises a first transistor pair which comprises a first transistor and a second transistor. The first transistor comprises a first MOS transistor and the second transistor comprises a second MOS transistor. The voltage reference circuit also comprises a second circuit that is configured to provide a second voltage component that changes at a second rate having a second slope as the temperature changes. The second circuit comprises a second transistor pair which comprises a third transistor and a fourth transistor. The third transistor comprises a third MOS transistor and the fourth transistor comprises a fourth MOS transistor. The voltage reference circuit also comprises a third circuit that is configured to use the first voltage component and the second voltage component to generate the reference voltage component that changes at a fifth rate having a fifth slope as the temperature changes.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims. In some embodiments, at least one current source referenced herein is an ideal current source.

Various operations of embodiments are provided herein. The order in which some or all of the operations are described should not be construed as to imply that these operations are necessarily order dependent. Alternative ordering will be appreciated given the benefit of this description. Further, it will be understood that not all operations are necessarily present in each embodiment provided herein. Also, it will be understood that not all operations are necessary in some embodiments.

Further, unless specified otherwise, "first," "second," or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or identical channels or the same channel It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used, such terms are intended to be inclusive in a manner similar to the term "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A voltage reference circuit, comprising:

a first circuit coupled between a first voltage source and a second voltage source and configured to provide a first voltage component, the first circuit comprising:

a first transistor having a first source/drain coupled to the first voltage source;

a second transistor having a first source/drain coupled to a second source/drain of the first transistor and a second source/drain coupled to the second voltage source;

a third transistor having a first source/drain coupled to the first voltage source;

a fourth transistor having a first source/drain coupled to a second source/drain of the third transistor and a second source/drain coupled to the second voltage source; and a fifth transistor having a first source/drain coupled to the first voltage source, wherein:

the second source/drain of the second transistor, the second source/drain of the fourth transistor, and the second voltage source are commonly coupled at a first node, and a gate of the first transistor, a gate of the third transistor, and a gate of the fifth transistor are commonly coupled at a second node;

a second circuit coupled between a third voltage source and a fourth voltage source and configured to provide a second voltage component, the second circuit comprising:

a sixth transistor having a first source/drain coupled to the third voltage source;

a seventh transistor having a first source/drain coupled to a second source/drain of the sixth transistor and a second source/drain coupled to the fourth voltage source;

an eighth transistor having a first source/drain coupled to the third voltage source;

a ninth transistor having a first source/drain coupled to a second source/drain of the eighth transistor and a second source/drain coupled to the fourth voltage source; and a tenth transistor having a first source/drain coupled to the third voltage source, wherein:

the second source/drain of the seventh transistor, the second source/drain of the ninth transistor, and the fourth voltage source are commonly coupled at a third node, and a gate of the sixth transistor, a gate of the eighth transistor, and a gate of the tenth transistor are commonly coupled together at a fourth node; and a third circuit comprising a first operational amplifier having a first input coupled to a second source/drain of the fifth transistor and a second input coupled to a second source/drain of the tenth transistor, wherein the third circuit is configured to use the first voltage component and the second voltage component to generate a reference voltage component that changes as a temperature to which the voltage reference circuit is subjected changes.

2. The voltage reference circuit of claim 1, the third circuit comprising a first resistor having a first terminal coupled to the second source/drain of the fifth transistor and a second terminal coupled to the first input of the first operational amplifier.

3. The voltage reference circuit of claim 1, wherein the second source/drain of the tenth transistor and the second input of the first operational amplifier are commonly coupled to a fifth node.

4. The voltage reference circuit of claim 2, the third circuit comprising a second resistor having a first terminal coupled to an output of the first operational amplifier and a second terminal coupled to the first input of the first operational amplifier.

5. The voltage reference circuit of claim 1, wherein the first voltage source applies a first voltage to the first source/drain of the first transistor and the third voltage source applies a second voltage to the first source/drain of the sixth transistor that is different than the first voltage.

6. The voltage reference circuit of claim 1, wherein the first voltage source applies a first voltage to the first source/drain of the first transistor and the third voltage source applies the first voltage to the first source/drain of the sixth transistor.

7. The voltage reference circuit of claim 4, the third circuit comprising a third resistor having a first terminal coupled to a fifth voltage source and a second terminal coupled to the first input of the first operational amplifier.

8. The voltage reference circuit of claim 7, wherein the first input of the first operational amplifier, the second terminal of the first resistor, the second terminal of the second resistor, and the second terminal of the third resistor are commonly coupled at a fifth node.

9. The voltage reference circuit of claim 1, wherein the second transistor and the fourth transistor have a same dopant type.

10. The voltage reference circuit of claim 1, wherein the second transistor, the fourth transistor, the seventh transistor, and the ninth transistor have a same dopant type.

11. The voltage reference circuit of claim 1, wherein:

the first source/drain of the second transistor is coupled to a gate of the second transistor, and the first source/drain of the fourth transistor is coupled to a gate of the fourth transistor.

12. The voltage reference circuit of claim 1, the first circuit comprising:

a second operational amplifier having an output coupled to the second node; and a resistor having a first terminal coupled to an inverting input of the second operational amplifier and the second source/drain of the first transistor and a second terminal coupled to the first source/drain of the second transistor.

13. The voltage reference circuit of claim 12, the first circuit comprising a second resistor having a first terminal coupled to the second source/drain of the fifth transistor and a second terminal coupled to the second voltage source.

14. The voltage reference circuit of claim 12, wherein:

the first terminal of the resistor, the inverting input, and the second source/drain of the first transistor are commonly coupled at a fifth node, and the second terminal of the resistor, the first source/drain of the second transistor, and a gate of the second transistor are commonly coupled at a sixth node.

15. A voltage reference circuit, comprising:

a first circuit coupled between a first voltage source and a second voltage source, the first circuit comprising:

a first transistor having a first source/drain coupled to the first voltage source;

a second transistor having a first source/drain coupled to the first voltage source;

a first operational amplifier having a first input coupled to a second source/drain of the first transistor and a second input coupled to a second source/drain of the second transistor; and a third transistor having a gate coupled to an output of the first operational amplifier and a first source/drain coupled to the second voltage source;

a second circuit comprising a second operational amplifier, wherein a first input of the second operational amplifier is coupled to a second source/drain of the third transistor; and a third circuit coupled between the first voltage source and the second voltage source, the third circuit comprising:

a fourth transistor having a first source/drain coupled to the first voltage source;

a fifth transistor having a first source/drain coupled to the first voltage source;

a third operational amplifier having a first input coupled to a second source/drain of the fourth transistor and a second input coupled to a second source/drain of the fifth transistor; and a sixth transistor having a gate coupled to an output of the third operational amplifier and a first source/drain coupled to the second voltage source, wherein:

the second circuit comprises a resistor, and a second source/drain of the sixth transistor is coupled to a second input of the second operational amplifier through the resistor.

16. The voltage reference circuit of claim 15, the first circuit comprising a fourth transistor having a first source/drain coupled to the second voltage source and a second source/drain coupled to the second source/drain of the second transistor.

17. The voltage reference circuit of claim 15, wherein a gate of the third transistor and the output of the first operational amplifier are commonly coupled to a first node.

18. The voltage reference circuit of claim 15, the first circuit comprising a resistor, wherein:

a first terminal of the resistor is coupled to the first voltage source, and a second terminal of the resistor, the second source/drain of the third transistor, and the first input of the second operational amplifier are commonly coupled to a first node.

19. The voltage reference circuit of claim 15, wherein a gate of the first transistor is coupled to the first input of the first operational amplifier.

20. A voltage reference circuit, comprising:

a first circuit coupled between a first voltage source and a second voltage source, the first circuit comprising:

a first transistor having a first source/drain coupled to the first voltage source;

a second transistor having a first source/drain coupled to the first voltage source;

a first operational amplifier having a first input coupled to a second source/drain of the first transistor and a second input coupled to a second source/drain of the second transistor; and a third transistor having a gate coupled to an output of the first operational amplifier and a first source/drain coupled to the second voltage source;

a second circuit coupled between a third voltage source and a fourth voltage source, the second circuit comprising:

a fourth transistor having a first source/drain coupled to the third voltage source;

a fifth transistor having a first source/drain coupled to the third voltage source;

a second operational amplifier having a first input coupled to a second source/drain of the fourth transistor and a second input coupled to a second source/drain of the fifth transistor; and a sixth transistor having a gate coupled to an output of the second operational amplifier and a first source/drain coupled to the fourth voltage source; and a third circuit comprising a third operational amplifier, wherein:

a first input of the third operational amplifier is directly coupled to a second source/drain of the third transistor; and a second input of the third operational amplifier is coupled to a second source/drain of the sixth transistor through a resistor.

* * * * *